US008763815B2

(12) United States Patent
Pellenc et al.

(10) Patent No.: US 8,763,815 B2
(45) Date of Patent: Jul. 1, 2014

(54) SORTING TABLE FEATURING GRADING ROLLS WITH MODIFIABLE AND ADJUSTABLE GAPS, AND MACHINES AND INSTALLATIONS MAKING USE THEREOF

(75) Inventors: Roger Pellenc, Pertuis (FR); Jean-Marc Gialis, Cheval Blanc (FR)

(73) Assignee: Pellenc (Societe Anonyme), Pertuis (FR)

( * ) Notice: Subject to any disclaimer, the term of this patent is extended or adjusted under 35 U.S.C. 154(b) by 385 days.

(21) Appl. No.: 13/292,597

(22) Filed: Nov. 9, 2011

(65) Prior Publication Data

US 2012/0131894 A1 May 31, 2012

(30) Foreign Application Priority Data

Nov. 26, 2010 (FR) ..... 10 04600

(51) Int. Cl.
*B07B 13/00* (2006.01)

(52) U.S. Cl.
USPC ..... 209/668; 209/673

(58) Field of Classification Search
USPC ..... 209/667, 668, 672, 673; 460/132; 171/133
See application file for complete search history.

(56) References Cited

U.S. PATENT DOCUMENTS

| | | | | | |
|---|---|---|---|---|---|
| 2,365,822 | A * | 12/1944 | Jones | 209/668 |
| 3,721,345 | A * | 3/1973 | Brown et al. | 209/669 |
| 4,120,363 | A * | 10/1978 | Ernst | 171/58 |
| 4,148,398 | A * | 4/1979 | Mustikka | 209/668 |
| 5,024,335 | A * | 6/1991 | Lundell | 209/618 |
| 5,060,806 | A * | 10/1991 | Savage | 209/668 |
| 5,590,793 | A * | 1/1997 | Johansson | 209/668 |
| 5,697,451 | A * | 12/1997 | Nicholson | 171/133 |
| 5,740,922 | A * | 4/1998 | Williams | 209/668 |
| 6,053,330 | A * | 4/2000 | Lavoie | 209/668 |
| 6,305,553 | B1 * | 10/2001 | Tirschler | 209/668 |
| 2009/0104953 | A1 * | 4/2009 | Kalverkamp | 460/123 |

FOREIGN PATENT DOCUMENTS

| | | |
|---|---|---|
| DE | 19904796 A1 | 8/1999 |
| FR | 2511575 A1 | 2/1983 |
| FR | 2938157 A1 | 5/2010 |

OTHER PUBLICATIONS

Corresponding Search Report for French Patent Application No. 10/04600 , issued Aug. 26, 2011.

* cited by examiner

*Primary Examiner* — Joseph C Rodriguez
(74) *Attorney, Agent, or Firm* — Egbert Law Offices, PLLC

(57) ABSTRACT

A sorting table with grading rolls supported by end supports and positioned to form a sorting plane. The rolls are rotated in the same direction and configured to create at least one opening between adjacent rolls to permit the pass-through of only the products to be sorted or calibrated. Larger products remain at the surface and are evacuated downstream. The gap between rolls can be modified. Elastic elements are interposed between said end supports and means of actuation for are provided bringing said end supports and the rolls supported by the latter closer together or moving them farther apart, in opposition to the antagonistic action exerted by said elastic elements, to decrease or increase the cross section of the openings, displacements in the opposite direction of said end supports and of the grading rolls being achieved by the action of extension or compression of said elastic elements.

19 Claims, 12 Drawing Sheets

SORTING TABLE FEATURING GRADING ROLLS WITH MODIFIABLE AND ADJUSTABLE GAPS, AND MACHINES AND INSTALLATIONS MAKING USE THEREOF

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a sorting table featuring grading rolls with modifiable and adjustable gaps. This sorting table may be fitted to perform the elimination of foreign objects being mixed in with the products of harvested small fruit; it may also be adapted to enable calibration of various agricultural, food products or other items, according to their size or caliber. It applies also to harvesting machines, in particular to grape picking machines featuring one or several sorting tables with grading rolls, as well as, in a more general manner, to installations, especially to stationary sorting installations that may for instance be built in cellars, in the grape crop receiving area or any other crop in the cellar.

The invention also concerns a process of modifying and adjusting the gap between the grading rolls of a sorting table.

According to a particularly interesting application, the sorting table with grading rolls according to the invention has the purpose to ensure the elimination of foreign objects (stalks, leaves, leaf or vine shoots, splinters of pickets or stakes, mineral debris, insects, small animals, etc.) that are mixed in with the grapes after stripping the grapes from the stalks, or with other products of the harvest of small fruit such as gooseberries, black currant, blackberries, raspberries, lingonberries, cranberries, olives, etc.

According to another possible application, the sorting table according to the invention may be laid out so as to permit calibration of various agricultural, food or other products such as potatoes, onions, garlic bulbs, French fries, apples, pears, shrimp and other crustaceans, etc.

2. Description of Related Art Including Information Disclosed Under 37 CFR 1.97 and 37 CFR 1.98

A sorting table with grading rolls more specifically intended to extract undesirable objects from a flow of fruit clusters spread out on said sorting table is for instance described in document EP-2.030.498. According to this document, this sorting table features a sorting system consisting of a succession of adjacent rotating rolls of a generally cylindrical shape in a parallel arrangement so as to form a sorting plane, and of motors for driving said rolls in the same direction, thus ensuring the transportation of the grape harvest crop dropped on the upstream part of this sorting plane, in a direction that is perpendicular to the axis of said cylindrical rotating rolls and over the entire length of said sorting plane, said cylindrical rotating rolls turning in place and being positioned so as to provide a number of openings between two adjacent rolls, in order to permit only the small fruit to be sorted to pass through and drop down, while any foreign objects larger than the fruit remain on the surface of the moving sorting plane and will be removed at the downstream end.

The sorting table with rotating rolls described in the aforementioned document yields excellent results in the application for which it is more specifically intended. However, it is not suitable for sorting grape berries or other clusters with considerable variations of size.

As a matter of fact, one of the major constraints faced by users of sorting tables with rolls featuring pass-through openings with a fixed cross section is the result of significant variance in size of the harvested products (for example the significant variance of the size of grape clusters depending on the grape varieties, etc.).

A primary solution allowing to vary the cross section of the pass-through openings made between the rolls consists of modifying their profile. However, this makes it necessary to have available several sets of rolls with different profiles and to remove and install all the rolls, depending on the size of the items to be sorted, which can be time consuming, complex and costly.

Mechanical solutions have been proposed (FR-2.511.575, FR-2.9938.157, U.S. Pat. No. 5,2927,427, GB-2.277.046, EP-0.951.950, DE-1.965.243, U.S. Pat. No. 7,117,996) to modify the gap between the calibration rolls and/or the cross section of the pass-through openings for the fruit, provided between the rolls.

However, these solutions utilize complex mechanical systems of design and operation which do not extend, in certain cases, beyond the realm of purely theoretical propositions.

Furthermore these systems:

- do not permit overriding their sorting or calibration function while maintaining their function of conveying the harvested product; and
- do not offer any security against the risk of damage which could result from the presence in the crop of a hard object getting stuck between two adjacent rolls.

BRIEF SUMMARY OF THE INVENTION

One aim of the present invention is to remedy the shortcomings and/or inadequacies of the sorting tables with grading rolls in which the adjustment of the pass-through opening or openings for the sorted or graded product is obtained by varying the gap between said grading rolls.

It is emphasized that the sorting table with grading rolls according to the invention applies not only to devices intended for the elimination of foreign objects mixed in with the harvested clusters and featuring a number of openings positioned between the rolls of each couple of adjacent rolls and meant for the pass-through and drop-down of the sorted or graded clusters, but applies also to grading devices in which a single slot has been made between two adjacent cylindrical rolls, parallel to them.

Considering the particularly advantageous application of the invention for the elimination of foreign objects mixed in with the products of the grape harvest, an example of implementation of this application is described below, but it is emphasized that this usage is by no means limiting.

According to the invention, this aim is being achieved with a sorting table with grading rolls comprising a number of grading or calibrating rolls which are supported, individually, through the intermediary of at least one of their ends, by end supports, these grading rolls being positioned in parallel succession to each other so as to form a sorting plane, and with means enabling said rolls to be driven in rotation in the same direction, so as to allow the harvested crop dropped on the upstream part of this sorting plane to be transported in a direction perpendicular to the axis of said rotating rolls, these rotating rolls being adapted or arranged so as to leave at least one opening or a number of openings, between two adjacent rolls, so as to allow the passing-through and the drop-down of the products to be sorted or only to be graded, the foreign objects or the products of greater size than that of the products to be sorted remaining on the surface of the mobile sorting plane and which are evacuated at its downstream end, said sorting table with grading rolls comprising also means which allow the gap of the rolls to be modified, and consequently the cross section of the opening or openings for the pass-through of the products depending on their size, so that said grading rolls are capable of occupying a maximal pass-through position in which the opening or openings have a maximum pass-through cross section, and a position of minimum width where the opening or openings have a cross section of minimal pass-through, the end supports of the grading rolls being mounted with a capability of limited transverse displacement on at least one lateral slide orientated perpendicularly to the axis of said rolls, with elastic elements being inserted between said end supports, and actuators to move said end supports and the rolls supported by them either closer together or farther apart, under the influence of the elastic elements, in opposition to the antagonistic action exerted by said elastic elements, so as to increase or decrease the cross section of the pass-through openings of the sorted or calibrated products, the displacements in the opposite direction of said end supports and of the grading rolls being achieved by the action of expansion or compression of said elastic elements, this sorting table being especially remarkable in that said lateral slide constitutes the driving means for the rotation of the rolls.

In an advantageous and especially intended manner of the invention, the grading rolls are supported through the intermediary of their opposing ends, through ends supports with a limited capability to move, on the one hand, on the lateral drive slide and, on the other hand, on a second lateral guiding slide orientated perpendicularly to the axis of said rolls, with elastic elements being inserted between said end supports and means allow to move the end supports and the grading rolls supported by them either closer together or farther apart.

According to a method of production, the elastic elements consist of helical springs acting under compression.

According to another method of production, the elastic elements consist of helical springs acting under traction.

According to another method of production, the elastic elements are made of an elastically compressible material.

According to an advantageous method of production, the elastic elements are mounted co-axially around the slide or around each lateral slide.

According to an advantageous implementation, the sorting table with grading rolls features feeder rolls positioned upstream of the grading rolls and supported by end supports mounted with a limited capability to move on the slide or each slide, said end supports being maintained at an invariable gap.

According to an advantageous method of production, the driving slide presents a cross section which permits its coupling in rotation with the input unit of a ring and pinion gearing integrated in the mobile end supports of the rolls, these ring and pinion gears being coupled, in a removable manner, to the drive end of said rolls.

According to a preferred method of production, the driving slide on which the ring and pinion gears are mounted has a polygonal or egg-shaped cross section.

According to a preferred method of production, the driving slide on which the ring and pinion gears are mounted has a hexagonal cross section.

According to a method of production, the sorting table features actuators working in sync and allowing the compression or expansion of the elastic elements inserted between the end supports of the grading rolls, these actuators comprising, on each side of the sorting table, a compression bar (in the case where the elastic elements consist of compression springs or elastically compressible elements) or an expansion bar (in the case where the elastic elements consist of extension springs), this bar being axially mobile and one of its ends is in contact with the end support of the "upstream" grading roll of the sorting table.

According to another characteristic arrangement, the actuators enabling the displacement of the mobile end supports of the rolls comprise a second, axially mobile push or traction bar and where one end of it is in contact with the support end of the "downstream" end of the sorting table.

According to one method of implementation, each compression or extension bar consists of a rack and the counterpart bars of each couple of push or traction bars are linked by at least one shaft for their synchronized displacement.

According to a method of production, the displacements of the couples of counterpart compression or traction bars are performed by pinions that are integral with the synchronization shafts positioned cross-wise below the sorting table.

According to a mode of implementation, the synchronization bars are equipped at one of their end with a pinion engaging with a sector gear that is integral with a manually operated tilting control lever and provided with a device allowing its immobilization in the desirable position.

According to another mode of implementation, the drive ends of the synchronization shafts are coupled to a motor providing their rotation.

The invention concerns also the harvesting machines for small fruit and in particular grape picking machines featuring at least one sorting table presenting the aforementioned characteristic arrangements.

According to a preferred method of production applied to the harvesting machines for small fruit, a shelling devise is placed above the feed rollers of the sorting table presenting the aforementioned characteristic arrangements.

According to another preferred method of production applied to the machines featuring at least one receiving bin of the crop, the sorting table is positioned above the upper opening of the bin(s), this method of production being also remarkable for a mechanism according to which the means of compression of the elastic elements allow the grading rolls to come closer together in a position leaving the bin freely accessible.

The invention concerns also the harvesting machines for small fruit featuring a sorting table with grading rolls presenting the aforementioned characteristic arrangements and a collecting vessel, with said sorting table being positioned above its upper opening, remarkable in so far as the latter features also means for partially neutralizing the sorting function of the sorting table and to conserve its conveyor function, said means permitting the displacement of all the rolls of the sorting table in the upstream direction, so as to create, downstream, an opening for direct access of the conveyed grapes to the collecting vessel allowing only the drop-off of the clusters and grapes in the vessel and the ejection from it, of the wood (stalks) mixed in with the conveyed crop, said access opening being delineated by one of the upper edges of the collecting vessel.

The invention aims further at a process of modification and adjustment of the gap between the grading rolls of a sorting table comprising a number of grading or calibrating rolls rotating in the same direction, supported by support end and arranged in parallel succession to each other so as to form a sorting plane, said rotating rolls being adapted or arranged so as to leave at least one opening or a number of openings, between two adjacent rolls, so as to allow the passing-through and the drop-down of the products to be sorted or only to be graded, the foreign objects or the products of greater size than that of the products to be sorted remaining on the surface of the sorting plane and which are evacuated at its downstream end, the grading or calibrating rolls being mounted with an adjustable gap, the end supports of the grading rolls being installed with a capability of limited transverse displacement on at least one lateral slide, or, preferably, on two lateral slides orientated perpendicularly to the axis of said rolls, and in so far as elastic elements are inserted between said end supports of the grading or calibrating rolls, this process being applicable to harvesting machines in which the sorting table is positioned above a collecting vessel for the sorted products, this process being remarkable in that the sorting function of said sorting table is completely or partially neutralized while maintaining its conveying function by moving all the rolls of the sorting table in the upstream direction and by making a space between the downstream end of the sorting table and one of the sides of the vessel, making it possible to create an opening for direct access of the unsorted or non-calibrated products to said receiving vessel, so as to allow the clusters and grapes to fall into the vessel and to eject, outside of said vessel, the wood (stalks) mixed in with the conveyed crop.

The process and the device according to the invention provide several interesting advantages, such as:

- permit the neutralization of the sorting or calibrating function while maintaining the function of conveying the products of the crop;
- ensure against the risk of damage which could result from the presence, in the crop, of a hard object getting stuck between two adjacent rolls,
- the removable mounting of the rolls on the end supports and the removable mounting of the elastic elements and of the distance pieces on the lateral slides permit modularity of the various elements constituting the sorting table.

BRIEF DESCRIPTION OF THE SEVERAL VIEWS OF THE DRAWINGS

The aforementioned aims, characteristics and advantages and still more, will become clearer from the detailed description below and the attached drawings in which.

Reference is made to these drawings to describe interesting but by no means limiting examples of the production of the sorting table with grading rolls with modifiable and adjustable gaps as per the invention.

DETAILED DESCRIPTION OF THE INVENTION

More specifically reference is made, as an example, to a sorting table of the kind described in document EP-2.030.498. The sorting table as per the present invention can just as well be applied to calibration tables with rotating rolls between which a single opening or slot is made parallel to the axis of said rotating rolls, for example of the kind of those described in documents U.S. Pat. No. 7,117,996 and U.S. Pat. No. 5,279,427.

In the present disclosure and in the claims the word "upper" is used in reference to the functional positioning of the components of the sorting table claimed.

The terms "upstream part", "downstream end", "upstream roll" and "downstream roll" are chosen in relation to the direction of displacement of the product that is being processed.

In the description and in the claims, the term "driving slide" designates the slide which communicates the driving motion to the rotating rolls and the term "guiding slide" designates the opposite slide.

Figure 13:
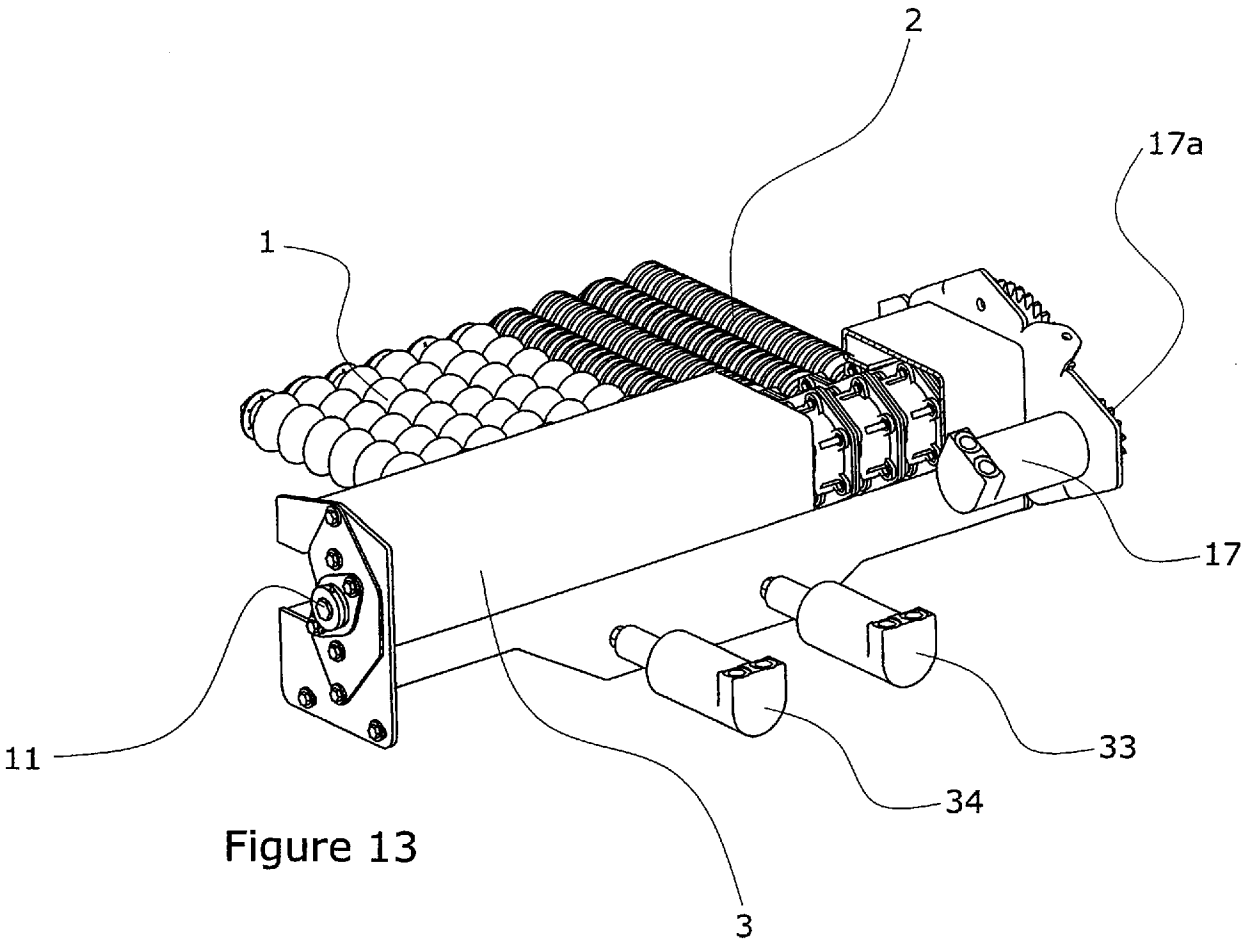
FIG. 13 is a perspective view of another method of production of the sorting table where the rolls are supported only through the intermediary of one of their ends.
Figure 14:
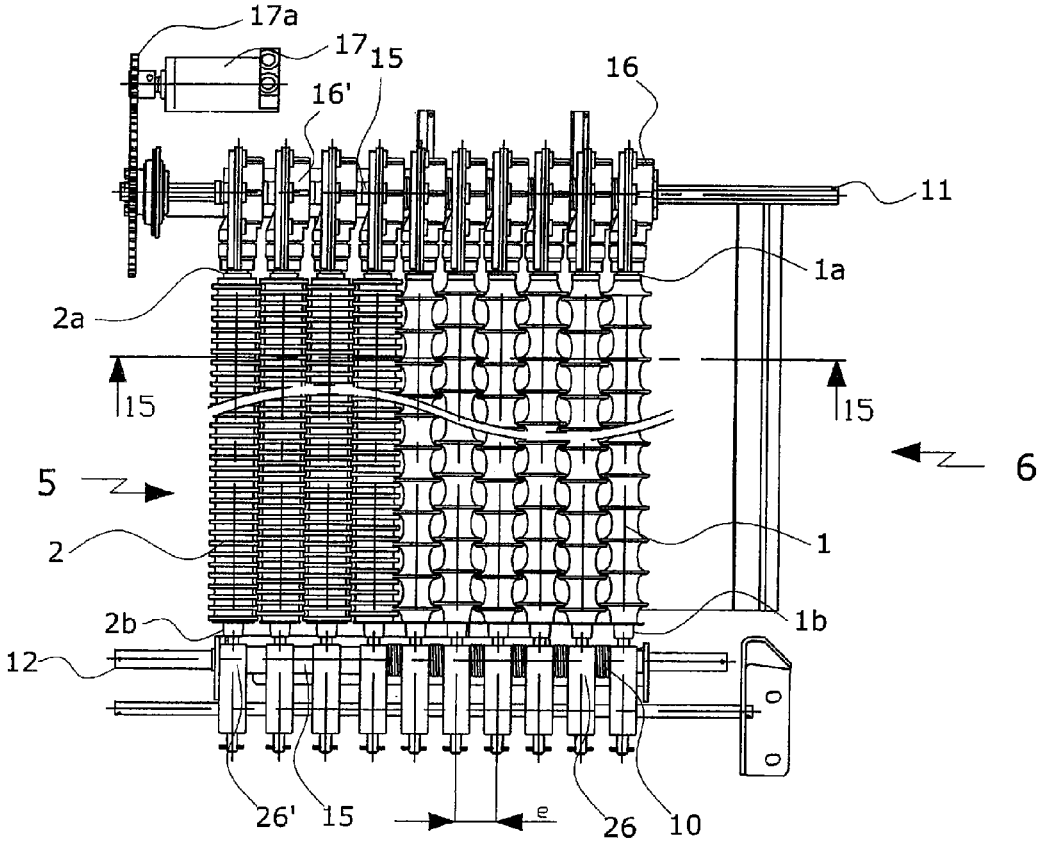
FIG. 14 is a top view where all the rolls forming the sorting table are moved upstream.
Figure 15:
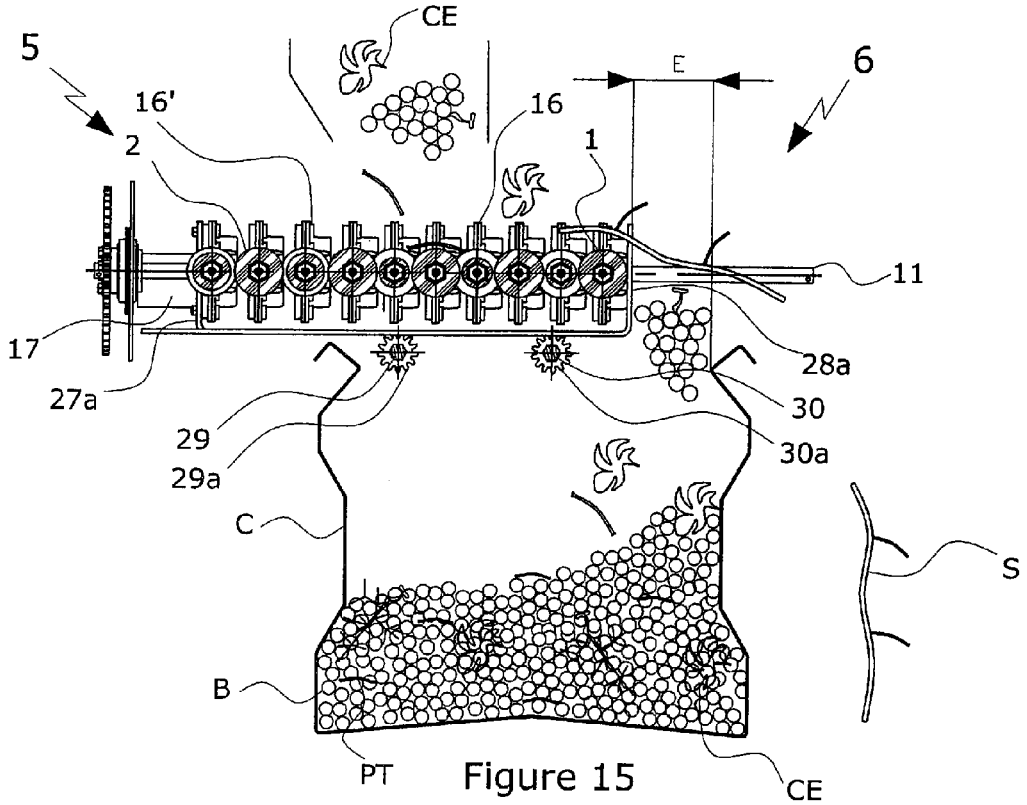
FIG. 15 is a section view along line 15-15 of FIG. 14 showing the sorting table in the position shown in FIG. 14 and placed above the upper opening of a vessel, which permits to create an opening for direct access to said vessel.
Figure 16:
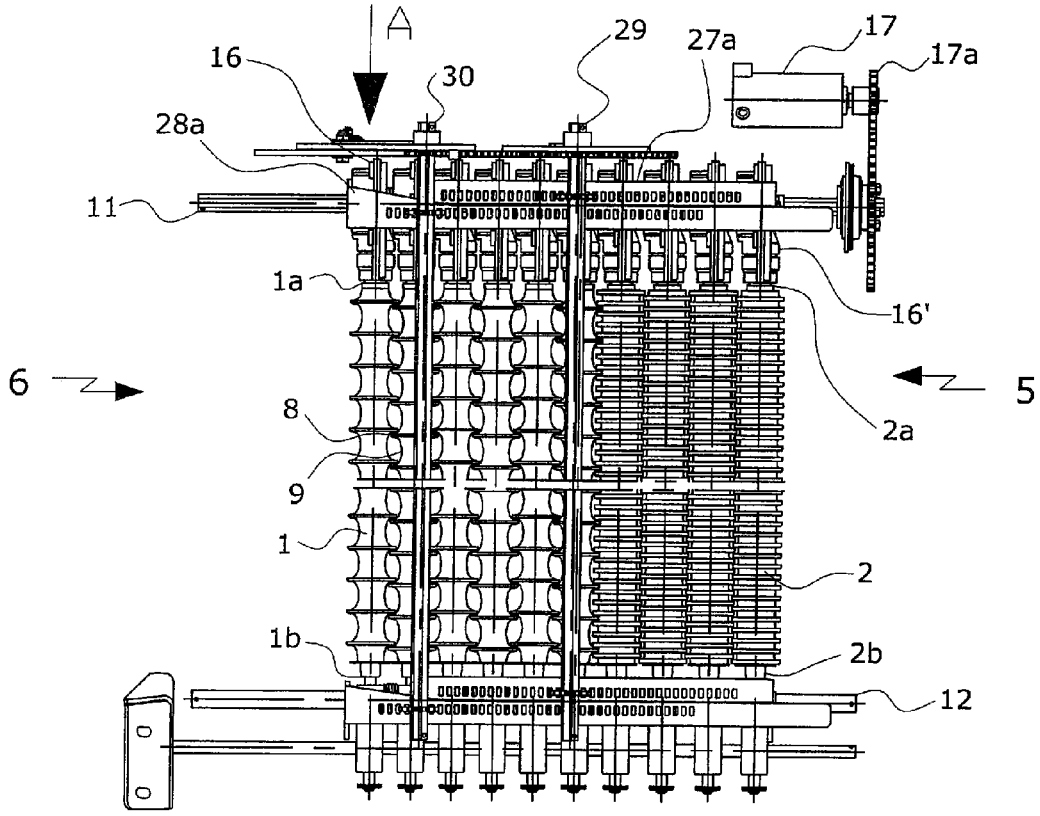
FIG. 16 is a view from below of FIG. 14.
Figure 17:
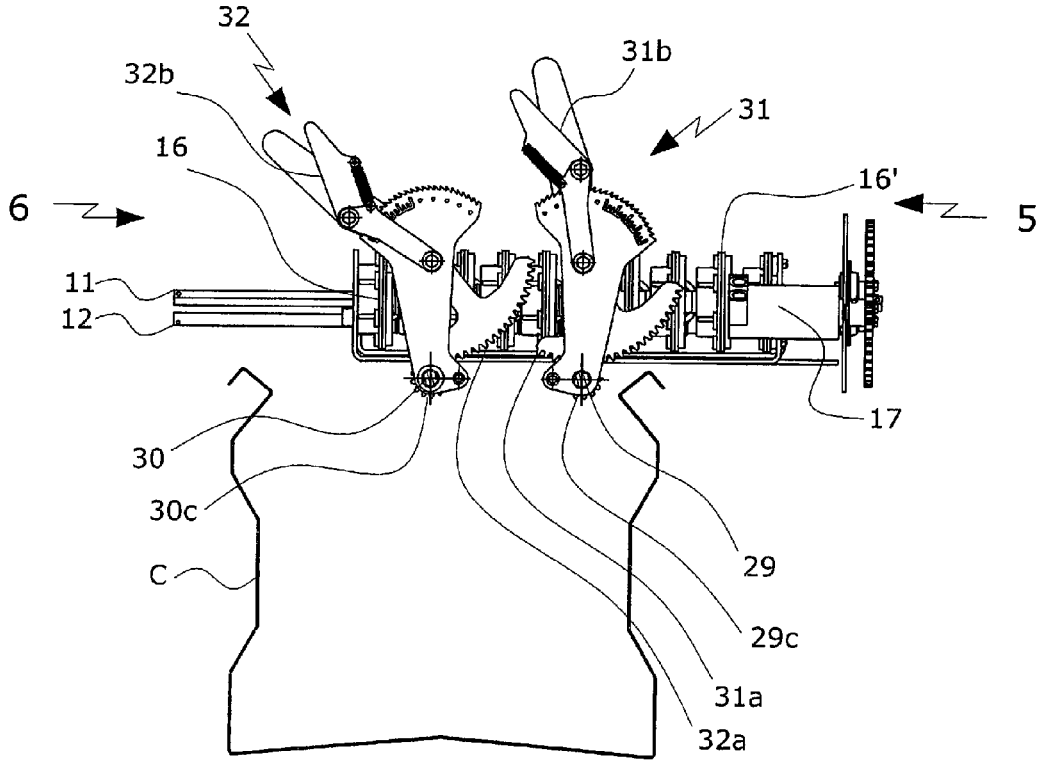
FIG. 17 is a side view of the sorting table in an operation analog to FIG. 15 and shown along the arrow A of FIG. 16.

According to the embodiment shown, the sorting table comprises of a succession of rotating grading and calibrating rolls next to each other of a generally cylindrical form 1, supported through the intermediary of at least one of their ends 1*a* (FIG. 13) by end supports 3 and placed in parallel, so as to form a sorting plane featuring an upstream part 5 and a downstream end 6. However, in a more specifically aimed manner, the grading or calibrating rolls 1 are supported, through the intermediary of each of their ends 1*a*, 1*b*, directly or indirectly, by end supports 3 and 4, and this very advantageous method of production is described and illustrated in detail in the following text of this statement and the attached drawings.

The grading rolls 1 are driven in rotation in the same direction by means that are described below, so as to permit a displacement of the grapes spread out on the upstream part 5 of this sorting plane, in a perpendicular direction to the axis of said rotating rolls 1, in the direction of the downstream end 6 of said sorting plane.

The grading rolls 1 are fitted and positioned so as to create at least one opening or calibrating slot (not shown) or, preferably, a number of openings 7, between two adjacent rolls, so as to enable the pass-through and the drop-down of the small fruit or other products to be sorted or to be calibrated, into a collecting vessel C positioned below the sorting table, the foreign objects or the products of a larger size than that of the small fruit remaining on the surface of the mobile sorting plane and being evacuated at the downstream end 6 of the sorting plane.

Each grading roll 1 can be made in the manner indicated in document EP-2.030.498. They comprise, in this case, of a succession of circular forms 8 separated by circular grooves 9. Furthermore, the circular forms 8 of each grading roll 1 are slightly offset in relation to the circular forms 8 of the adjacent grading roll(s) 1 and their edges are engaged in the grooves 9 of the adjacent roll(s) so as to permit the formation of sorting or calibrating openings 7 of round or approximately round shape and so dimensioned that they allow only the pass-through of the small fruit to be sorted or calibrated.

It is however emphasized that the grading rolls 1 could have a different shape, so as to create a single opening or slot between two adjacent rolls for the calibration of certain products.

The opposing ends 1*a*, 1*b*, of the grading rolls 1 are supported, directly or indirectly, by end supports 3, 4 mounted with capability of transverse displacement with a limited amplitude perpendicularly to the rotation axis of said rolls and elastic elements 10 are interposed between said end supports 3, 4.

Preferably, these elastic elements 10 consist of spiral springs acting in compression. It is obvious that by exerting an approaching action between the end supports 3, 4 of the grading rolls 1, beginning at their maximum gap position corresponding to a maximum dimension of the openings 7, all springs 10 will be equally compressed. In this manner all the rolls 1 are coming closer together and the size of the pass-through openings becomes smaller.

The device can function in the following manner, beginning at a resting position where the rolls are in their maximum gap width position.

According to the embodiment shown, in order to obtain the approaching action of the grading rolls 1 and the reduction of the size of their openings 7, the farthest downstream roll is immobilized and the farthest upstream roll is moved in the downstream direction so as to bring it closer to the roll that is the farthest downstream.

Alternately, the end supports 3, 4 of the grading rolls 1 could be connected to each other through the intermediary of spiral springs acting in extension (not shown) by any removable means of connection. In this case, one understands that any effort of widening the gap of the end supports 3, 4 from a position of minimum width corresponding to a minimum dimension of the openings 7 results in an equal extension of all the extension springs. In this way, a widening of the gap between all the rolls 1 and an increase of the size of the pass-through openings 7 are obtained.

The device can function in the following manner, beginning at a resting position where the rolls are in their minimum gap width position.

According to the embodiment shown, in order to obtain the gap widening action of the grading rolls 1 and the increase of the size of their openings 7, the farthest downstream roll is immobilized and the farthest upstream roll is moved in the upstream direction so as to move it away from the roll that is the farthest downstream.

According to a third possible way of carrying out the invention (not shown), elastic elements made of a compressible material can be interposed between the end supports 3, 4 of the grading rolls 1. In this case, these elastically deformable elements behave like springs acting under compression.

The elastic elements 10 (compression springs, extension springs or elastically deformable elements) having all the same or essentially the same degree of stiffness, their natural actions of extension or of compression tending to return them to a balance position are identical or approximately identical, so that the center distance of axes "e" of two adjacent grading rolls 1 remains always the same or approximately the same, over the entire length of the succession of grading rolls 1, regardless of the dimension of this center distance of axes "e".

The end supports 3, 4 and the elastic elements 10 which separate them are mounted with a limited capability of displacement on lateral slides 11, 12 orientated perpendicularly to the axis of the grading rolls 1.

The end supports 3, 4 and the elastic elements 10 which separate them are mounted coaxially, with a capability of limited displacement, on lateral slides 11, 12 orientated perpendicularly to the axis of the grading rolls 1.

It is noted that according to another possible way of carrying out the invention, the elastic elements 10 interposed between the mobile end supports 3 and 4 could be positioned near the slides 11 and 12.

For each calibrating roll 1, these end supports comprise, on the one hand, of a transmission case 3, and on the other hand, of a locking module 4.

The sorting table according to the invention could consist of just a number of grading or calibrating rolls 1. However, preferably and advantageously, the sorting table features also feed rollers 2 positioned upstream of the grading or calibrating rolls 1 and whose function it is to orient scrap of elongated shape perpendicularly to the axis of rotation of said rolls to transport them, in that position, to the assembly of grading or calibrating rolls 1, while allowing the elimination of small debris or scrap. The function of said grading or calibrating rolls 1 is to separate the clusters from the foreign objects that need to be eliminated, or to separate the clusters of small size from the undesirable clusters of a larger size. An example of production of such feed rollers is described in document EP-2.030.498.

According to this embodiment, the rotating feed rollers 2 constituting the upstream part 5 of the sorting plane feature a succession of circular forms 13 separated by circular grooves 14 and are so positioned that the circular forms 13 of these rolls are interleaved in the circular grooves 14 of the adjacent roll or rolls. An interstice or set "i" in the form a baffle of reduced size being inserted between the parts which interlock with adjacent rolls 2. This interstice "i" presenting, for example, a width in the order of 2 to 3 mm, so as to let pass only the debris or scrap of very small size (seeds, small mineral or vegetable scrap, etc.).

The feed rollers 2 are maintained at a fixed gap for instance by means of rigid distance pieces 15 interposed between the end supports 3, 4 of each couple adjacent of feed rollers 2.

According to an important characteristic arrangement of the invention, the means for driving in rotation, in the same direction, of the rolls 1, 2 comprise one (11) of the lateral slides 11, 12.

According to a preferred embodiment, this slide, called the drive slide 11, presents a cross section which permits its coupling in rotation with the input unit of a transmission case 3. For example, the means for driving in rotation may comprise angle transmissions integrated in the mobile end supports 3, these angle transmissions being coupled, in a removable manner, to one of the ends, or drive end of said rolls 1, 2.

The drive slide may feature for this purpose a polygonal, preferably hexagonal or egg-shaped cross section.

The drive from the slide 11 may be obtained by other means known by the experts such as a corrugated cross section, key way, flattened section, etc.

The slide 11 is driven in rotation by any appropriate drive motor 17 (electric, hydraulic, pneumatic, thermal . . . geared motor) coupled, for example by means of a gear 17*a*, to one of the ends of said slide 11.

The guide slide 12 may present a circular cross section.

Figure 11:
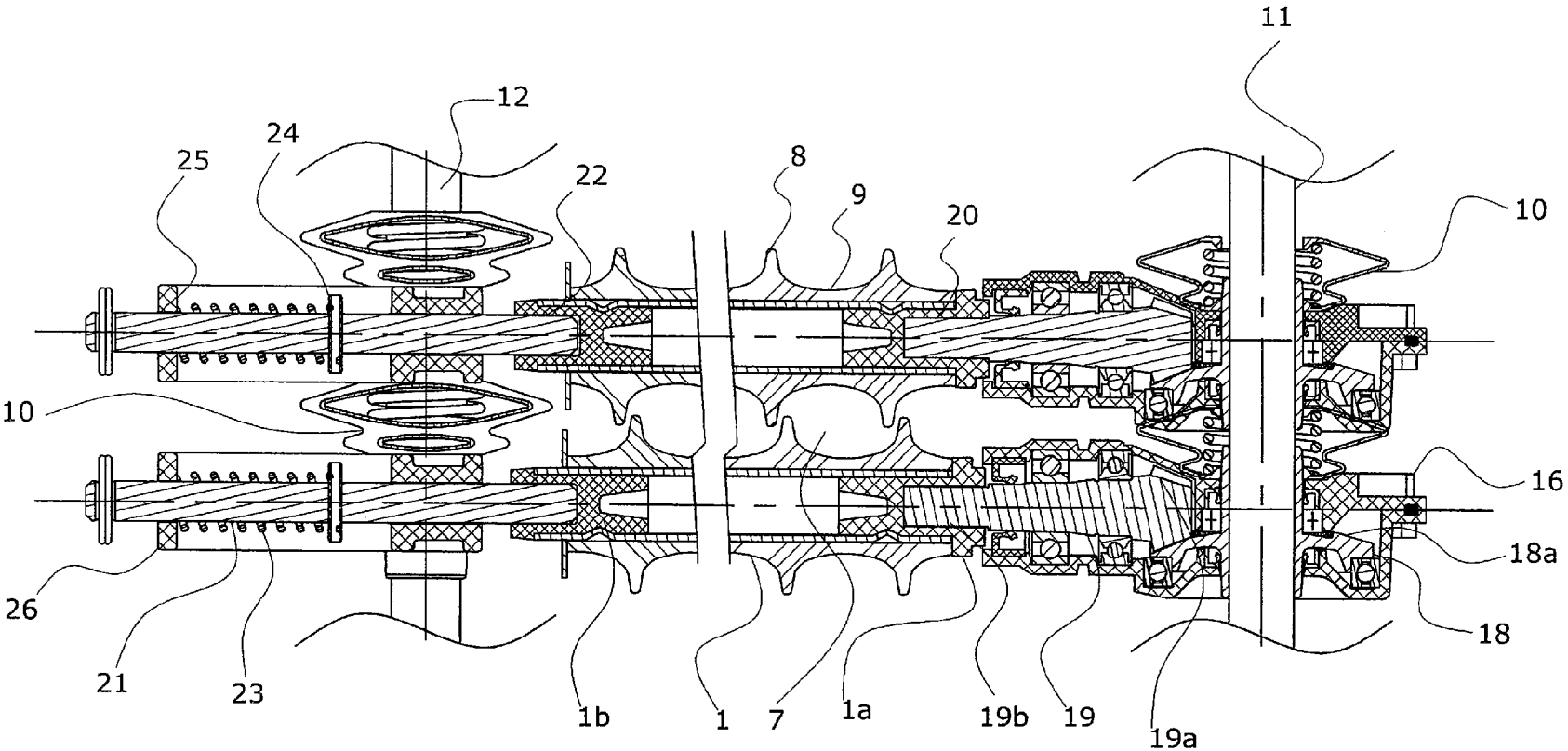
FIG. 11 is a detailed sectional view illustrating the removable coupling of the ends of a couple of grading rolls with, on the one hand, an angle transmission and, on the other hand, a support bearing chamber.
Figure 12:
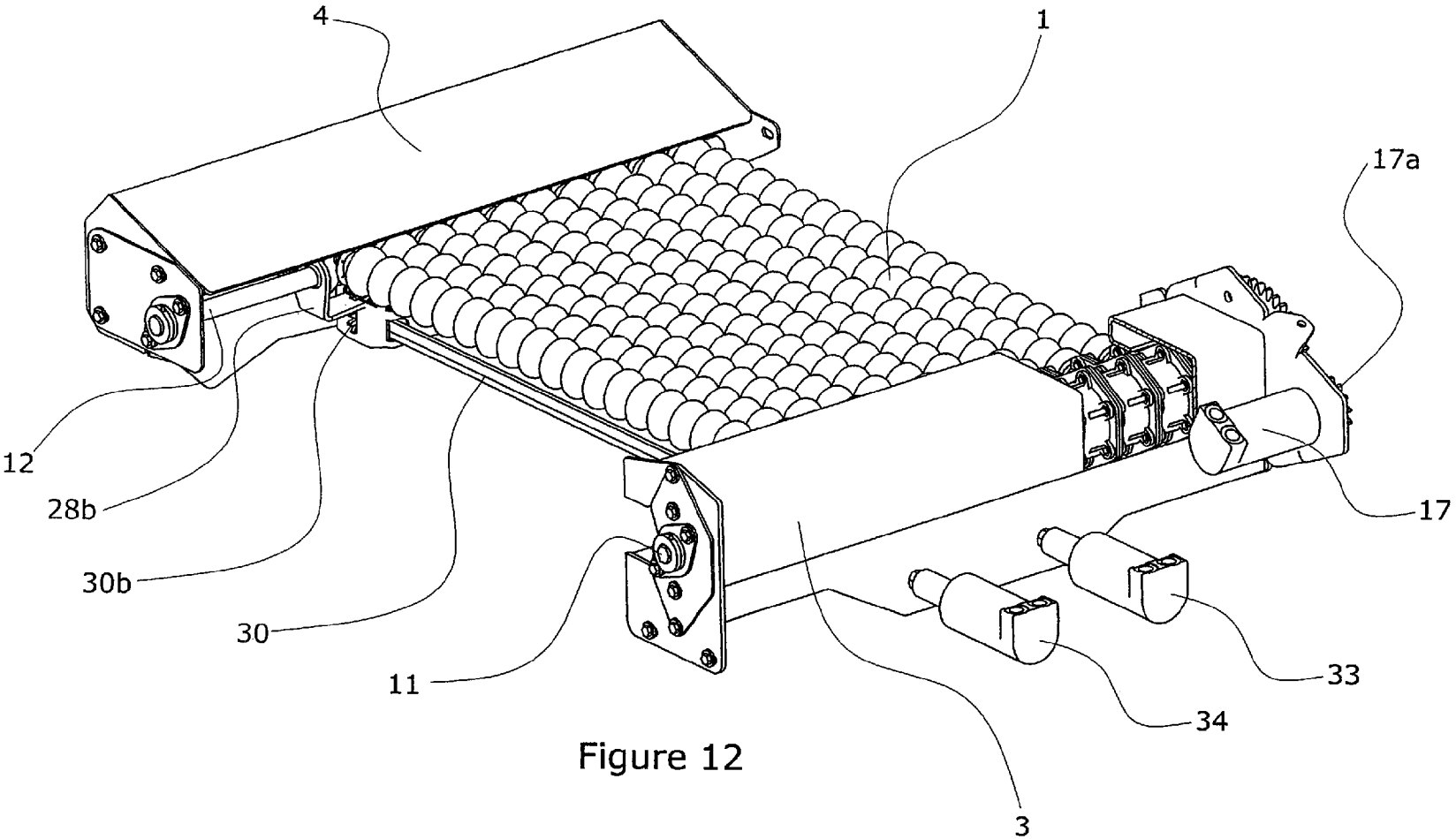
FIG. 12 is a perspective view illustrating a simplified example of production of a sorting table consisting only of a succession of grading rolls.

The feed rollers 2 and the grading rolls 1 are mounted in a removable and interchangeable manner in the end supports 3, 4. One example of embodiment of the removable assembly of rolls 1 and 2 is illustrated in FIG. 11. The example of removable assembly of the rolls is represented in that figure with reference only to the grading rolls 1, it being understood that it may be identical for the feed rollers 2.

According to this example, on the side of the drive slide 11, each angle transmission 16 features an internal gear 18 with a central hole of polygonal, for example hexagonal shape, to be crossed by the slide 11 and so that it can be driven in rotation by the latter. Each gear 18 of the angle transmission 16 is shaped so as to mesh with an organ 19 the axis of which is perpendicular or approximately perpendicular to that of the slide 11. For example, the gear 18 may present a peripheral wheel 18*a* of tapered shape, driving in rotation a pinion 19*a* located at the proximal end of organ 19, also of tapered shape, so that the axis of the rotational output movement, i.e. the axis of rotation of organ 19, is orthogonal to the axis of the rotational input movement, i.e. the axis of rotation of the crown 18 which is identical to that of slide 11.

The distal end 19*b* of organ 19 is engaged in a removable manner in a boring 20 presented by the drive end 1*a*, 2*a* of the bars of rolls 1, 2. This coupling of organ 19 and of the bar of rolls 1, 2 is such that it permits the transmission of the rotational movement of said organ to said bar.

The opposite end 1*b*, 2*b* of rolls 1, 2 is supported, in a removable manner, by end supports 4, 4' for instance constituted by a support bearing case. The support cases themselves are mounted on the opposite lateral slide, or guide slide 12, with a capability of limited displacement.

On the side of the guide slide 12, the coupling of the end 1*b* or 2*b* of the rolls may be made through the intermediary of a number of retractable axes supported by the end supports 4, 4' and engaged in a boring presented by said end of the bars of rolls 1, 2. These retractable axes 21 are subjected to the action of an elastic means tending to push them back into the coupling position. This elastic means is, for example constituted by a spiral spring 23 acting under compression, placed around axis 21 and set between a washer 24 fixed on the internal portion of said axis and the side 25 of the bearing structure.

In the case where the grading rolls 1 and the feed rollers 2, if they are present, are supported by end supports 3, 3' through the intermediary of only their drive end 1*a* or 2*a*, the sorting table features a single rotational drive slide 11 on which are mounted said end supports 3, 3' which integrate the angle transmissions 16, 16'. Such a simplified arrangement is particularly intended for sorting or calibrating machines with rolls of reduced length, for instance in the order of 60 cm, whereas sorting tables with rolls that are supported on both ends, may feature grading rolls 1 and feeder rolls 2 of much greater length, for example in the order of 1.60 m.

The sorting table as per the invention comprises also means for modifying the gap between the grading or calibrating rolls 1 and, consequently, the cross section of the pass-through opening or openings for the products, depending on the size of the latter, so that said grading rolls 1 are capable of being in a position of maximum gap in which the opening or openings have a maximum pass-through cross section (FIGS. 2, 3, 6, and 7), and a position of minimum gap where the opening or openings have a minimal pass-through cross section (FIGS. 4, 5, 8, and 9).

Because of the arrangement described above, when the crop is spread, after stalk removal, on the upstream part 5 of the sorting plane, it is first conveyed in the direction of the downstream part of the plane, by the feeder rolls 2. During this first phase: —the small foreign objects "P" (seeds, vegetable or mineral debris, . . . ) and the juice pass through the interstices "i" and drop into an open-worked tub (not shown) placed below said rolls for the recovery of the juice; —the debris of elongated shape "PT" (petioles, twigs, canes, . . . ) is orientated perpendicularly to the axis of rolls 1 and 2 from the time they come into contact with the feeder rolls 2 and are conveyed in this position, together with the crop that has thus been freed from its small foreign objects, in the direction of the grading rolls 1. During this second phase, the grape clusters B pass through the openings 7 created between the grading rolls 1 and are recovered in a bin C (if the sorting table is mounted on a grape harvesting machine) or in a vat installed in fixed position, or perhaps in a grape pump (if the sorting table is installed in fixed position) placed under the grading rolls 1. The foreign objects "CE" such as leaves, pieces of canes or grape stalks, etc. "float" on the grading rolls 1 and are conveyed to the downstream end 6 of the sorting table where they are ejected from the latter.

The feeder rolls 2 and the grading rolls 1 are mounted in a removable and interchangeable manner on the load-carrying structure of the sorting table.

The sorting table includes also means of actuation by which the end supports 3, 4 can be brought closer together or moved further apart and consequently the grading rolls 1 supported by the latter can be brought closer together or moved further apart.

According to a first mode of implementation, these means of actuation that are applicable to sorting tables using elastic elements 10 comprising of spiral compression springs or elements made of elastically compressible material, are fitted so as to permit the compression of the elastic elements 10 interposed between the end supports 3, 4 of the grading rolls 1 and to bring said rolls closer together, starting at a maximum gap position.

According to another embodiment, these means of actuation that are applicable to sorting tables using elastic elements 10 consisting of spiral extension springs, are fitted so as to permit the extension of the elastic elements 10 interposed between the end supports 3, 4 of the grading rolls 2 and to move said rolls farther apart, starting at a minimum gap position.

The sorting table features means for synchronizing the displacement of the end supports 3, 4 and consequently, of the rolls themselves, on the slides 11, 12.

According to one embodiment, the means of actuation comprise, on at least one of the sides (as for the embodiment of FIG. 13), or preferably on each side of the sorting table, a compression or extension bar 27 that is axially mobile and has one end bent at 90° and is in contact with the end support 3, 3' or 4, 4' of the "upstream" roll of the sorting table.

According to another characteristic arrangement, the means of actuation for the displacement of the mobile end supports of rolls 1, 2 comprise a second push or traction bar 28 that is axially mobile and has one end bent at 90° and is in contact with the end support 3, 3' or 4, 4' of the "downstream" roll of the sorting table.

According to another embodiment, the means of actuation could comprise of double-acting cylinders, in contact with the extreme end supports 3, 3', 4, 4' supporting respectively the roll which is the upstream end of the sorting table and the roll which is the downstream end of the sorting table.

According to an advantageous embodiment, said homologous bars of each couple of push or traction bars 27*a*-27*b*, 28*a*-28*b* are linked by at least one rotating shaft 29, 30 to ensure their synchronized displacement.

Each compression or extension bar of the couples of homologous bars 27*a*-27*b*, 28*a*-28*b* comprise of a rack engaged with a pinion 29*a*, 29*b*, 30*a*, 30*b* respectively, integral in rotation with the synchronization shaft 29, 30, positioned cross-wise under the sorting table.

Because of the arrangement described above it is possible to neutralize the function of the sorting table while maintaining the conveyor function, as is explained below.

According to one embodiment, the synchronization bars 29, 30 are equipped at one of their ends with a pinion 29*c*, 30*c* meshing with a sector gear 31*a*, 32*a* that is an integral part of a manually operated tipping control lever 31, 32.

The control levers 31, 32 are advantageously equipped with a device (ratcheting device for example) by which they can be immobilized in the desirable position in order to maintain the desired gap "e" between the grading rolls 1, depending on the size of the clusters or other products to be sorted or calibrated.

Figure 1:
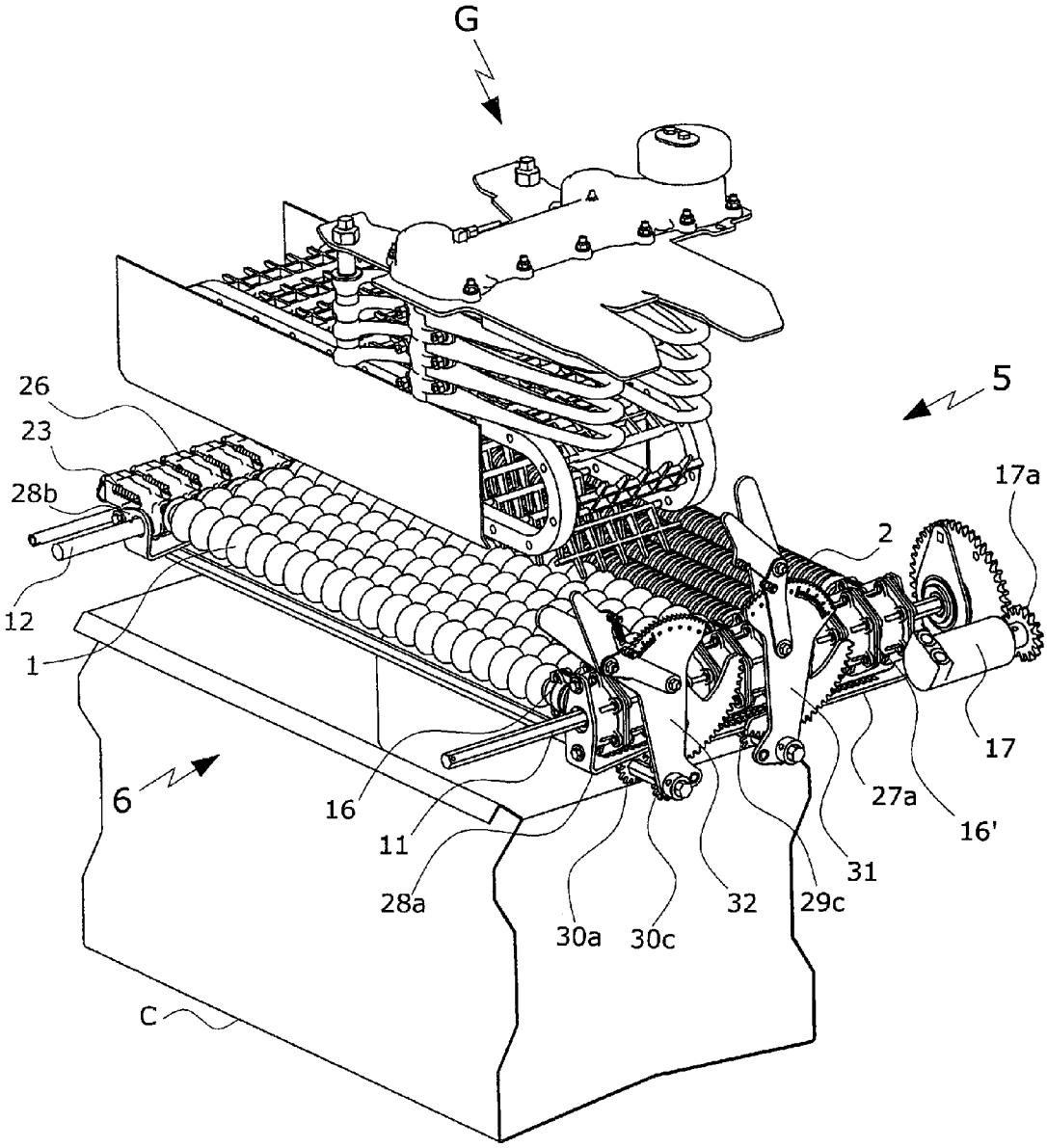
FIG. 1 is a perspective view illustrating an example of installation equipped with a sorting table with grading rolls as per the invention.
Figure 2:
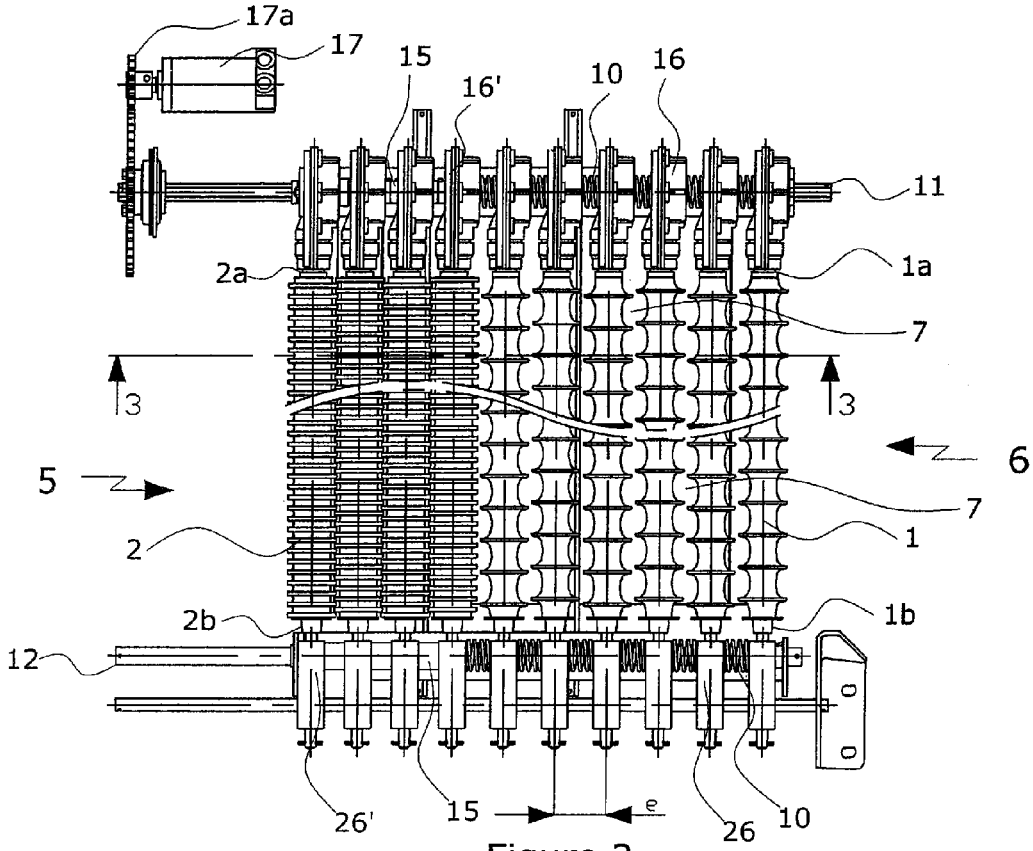
FIG. 2 is a top view of an advantageous example of the sorting table according to the invention, shown in a position of maximum width between the grading rolls.
Figure 3:
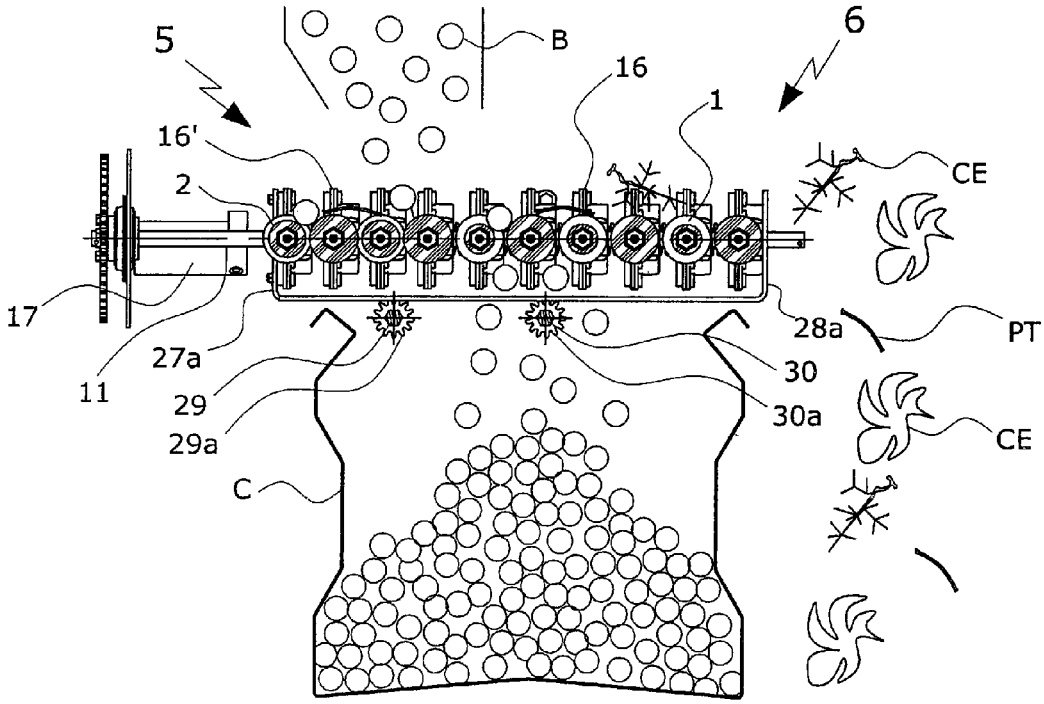
FIG. 3 is a section view along line 3-3 of FIG. 2, the sorting table being positioned above a receiving vessel and illustrated in the operating state.
Figure 4:
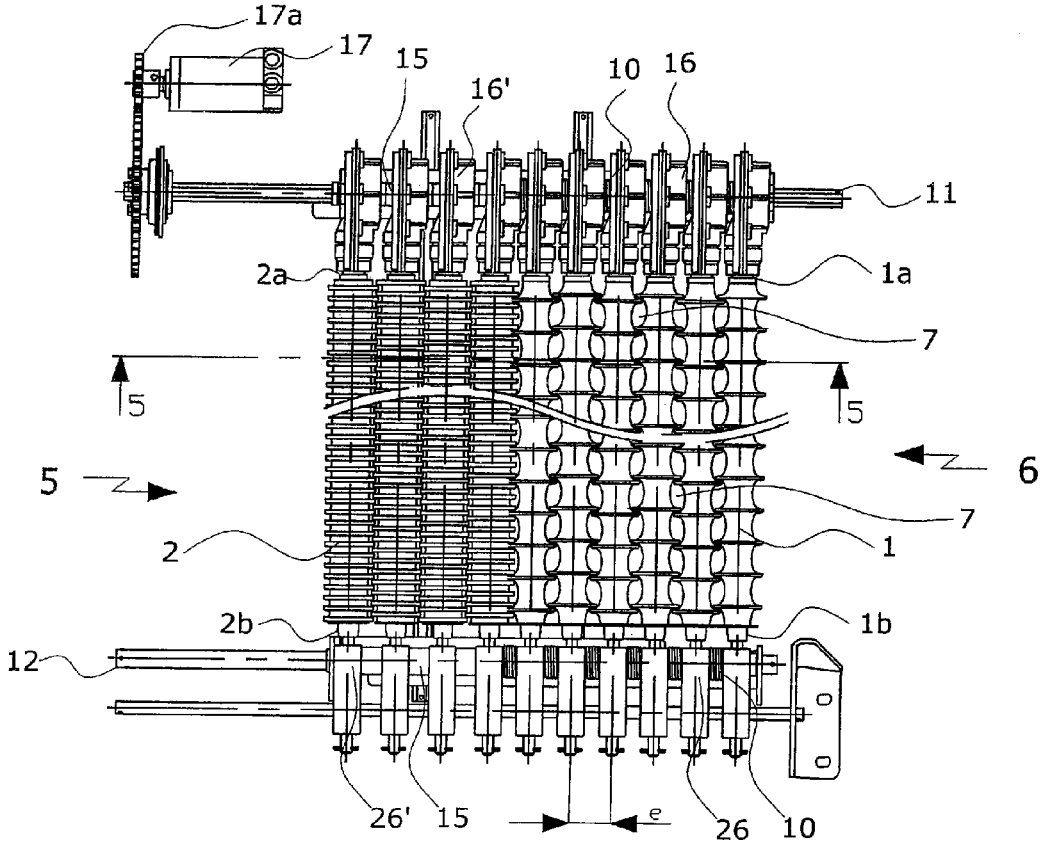
FIG. 4 is a view analog to FIG. 2 and shows the grading rolls in the minimum width position.
Figure 5:
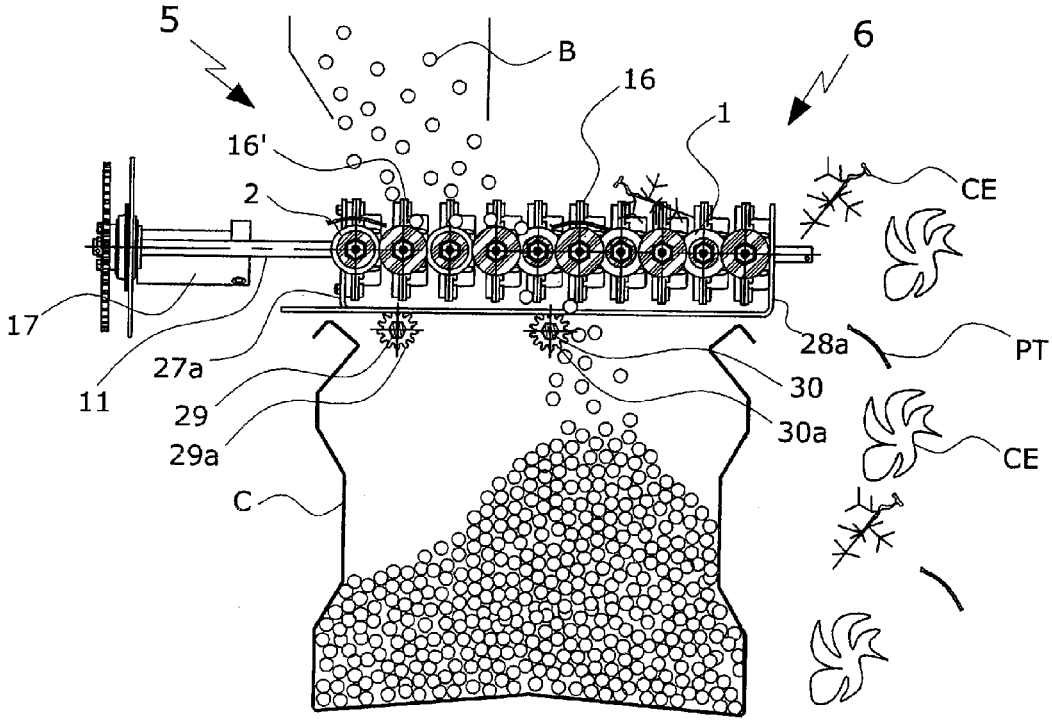
FIG. 5 is a view analog to FIG. 4, showing the sorting table in a section along the line 5-5 of FIG. 4.
Figure 6:
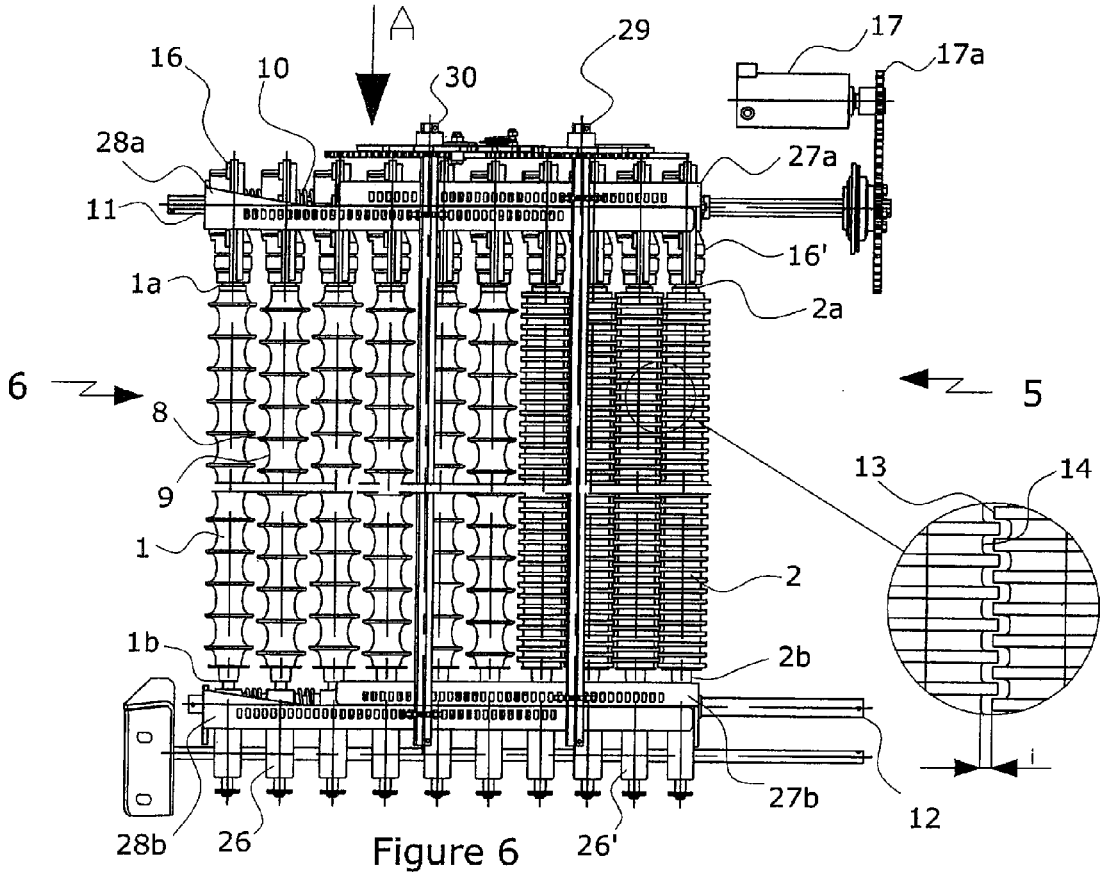
FIG. 6 is a view from below the sorting table showing more specifically the means for displacement of the rolls on the lateral slides, the rolls being shown in a position of maximum gap width.
Figure 7:
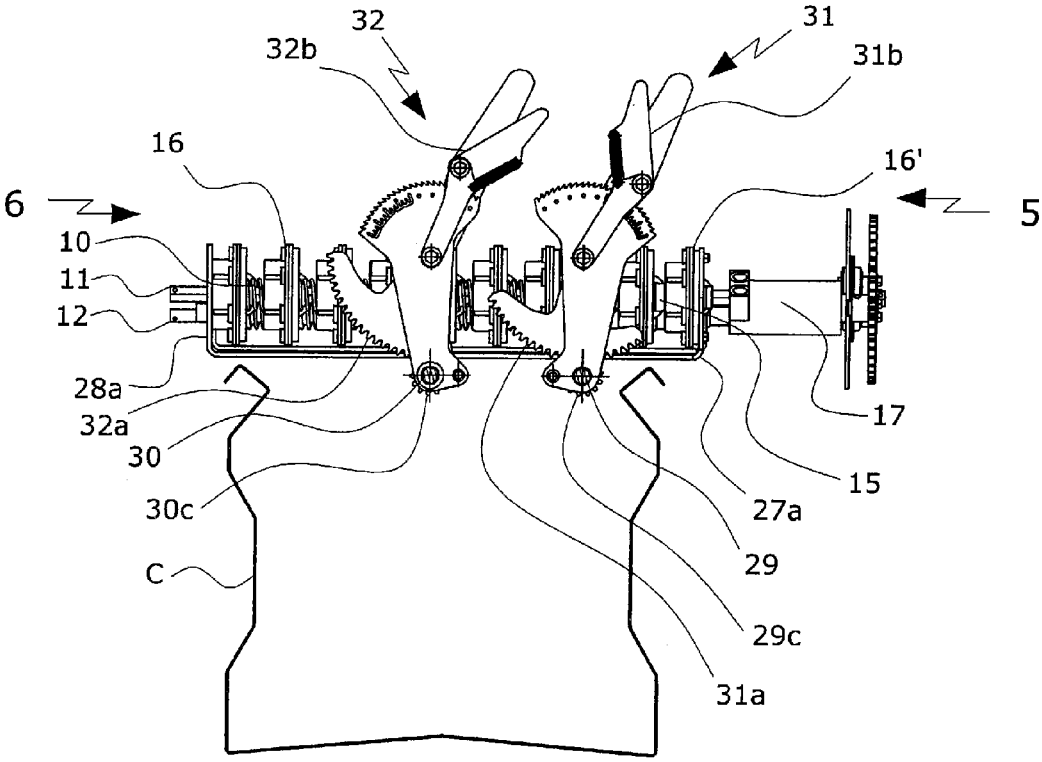
FIG. 7 is a side view seen along the arrow A of FIG. 6 showing a manual control system of the devices for displacement of the rolls on the lateral slides.
Figure 8:
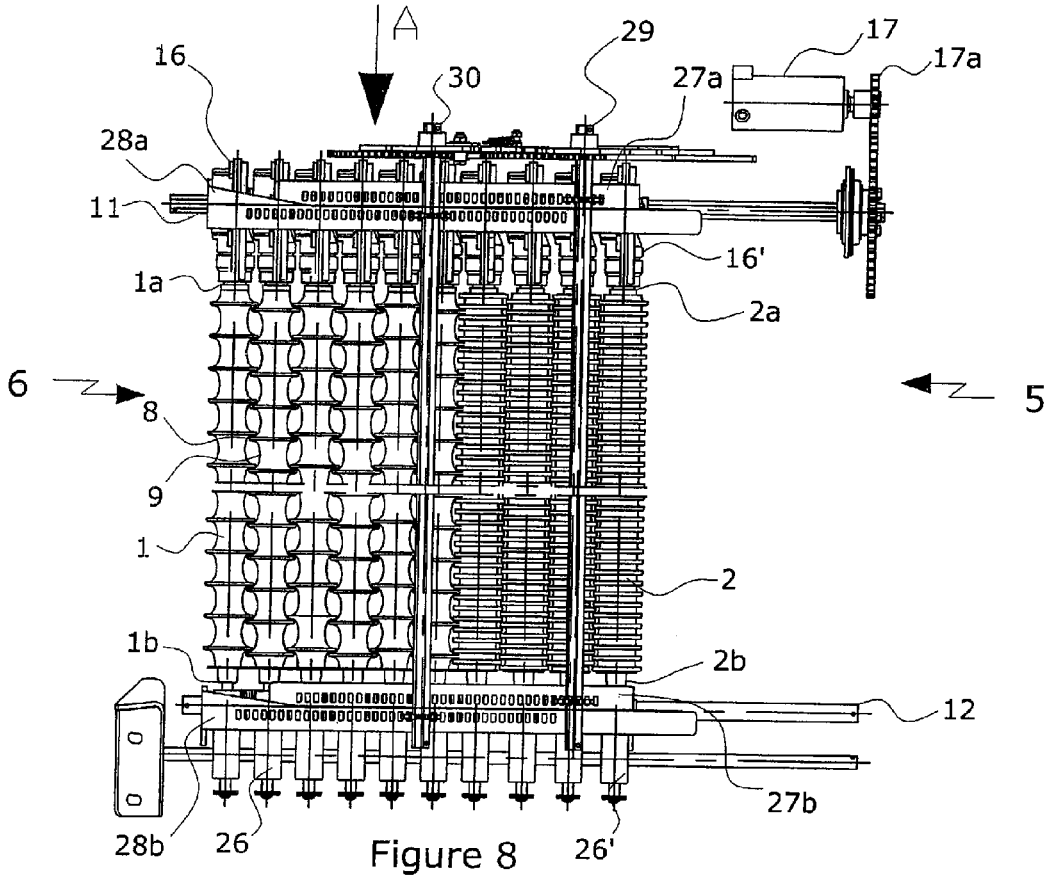
FIG. 8 is a view from below, analog to FIG. 6, showing the grading rolls in a minimum gap position.
Figure 9:
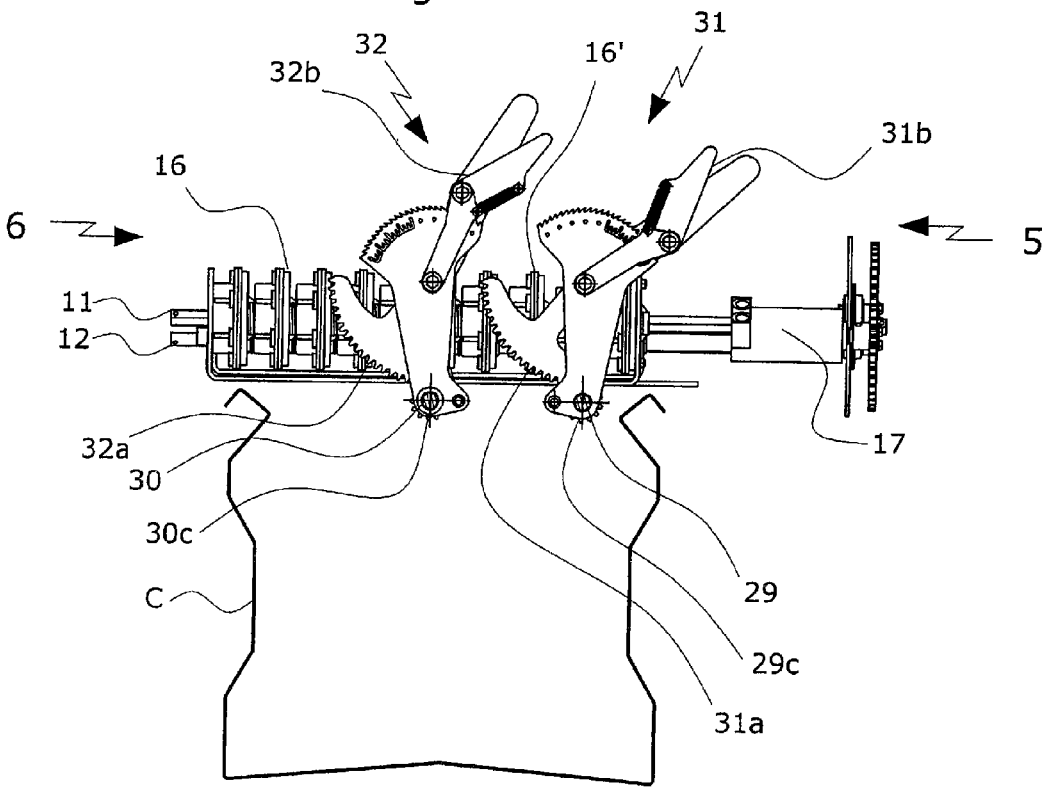
FIG. 9 is a view analog to FIG. 7 showing the position of the manual control device in the location shown in FIG. 8.
Figure 10:
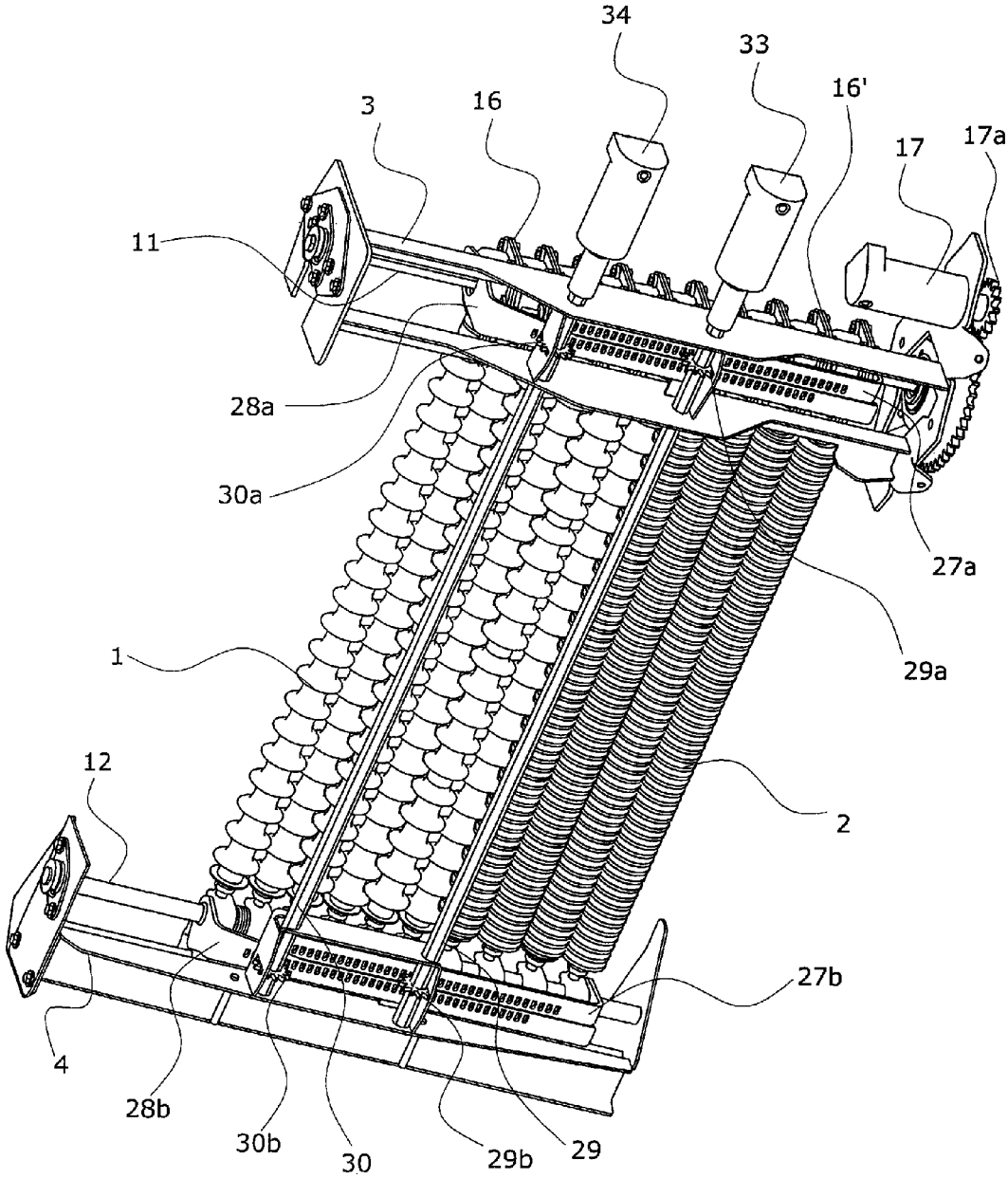
FIG. 10 is a view from below, illustrating another mode of actuation of the means for displacement of the rolls on the lateral slides.

According to another method of production, the drive ends of the synchronization shafts are coupled to a motor 33, 34 (see FIG. 10) providing for the rotation of said synchronization shafts.

The invention covers also the harvesting machines for small fruit and, more particularly, the grape harvesting machines featuring a sorting table with grading rolls presenting the previously described characteristics.

These machines may feature a stripping device G placed above the feeder rolls 2 of said sorting table which is itself positioned above the upper opening of collecting vessels C for receiving the crop, these vessels consisting usually of bins installed in the upper part of the machines.

According to the implementation shown, the means of compression 27*a*, 27*b*, 28*a*, 28*b* of the elastic elements make it possible to bring the grading rolls 1 together in a position leaving free access to the collecting vessel C the machine is equipped with, according to the invention, so the grape clusters B together with leaves and grape stalks can be directly dropped into said bin, when the nature of the grape varieties and the processes of wine-making make their non-separation desirable. In this case, only the large waste items find themselves ejected by passing above the direct access opening to the bin due to the kinetic energy communicated by the rotation of the grading rolls 1.

The invention also covers the fixed sorting installations, in particular in cellars, of the type featuring a sorting table with grading rolls presenting the characteristics previously described, and a reception vat C above an opening of which the sorting table is positioned.

The invention concerns also a process of modification and adjustment of the gap between the grading rolls 1 of a sorting table comprising a number of grading or calibrating rolls 1 turning in the same direction, supported by end supports 3, 4 and placed parallel to each other in succession, so as to form a sorting plane. The rotating grading rolls 1 are shaped or positioned in a manner to create at least one opening or a number of openings 7 between the adjacent rolls of each couple of rolls, so as to permit the pass-through and the drop-off of the products only to be sorted or to be calibrated, the foreign objects "CE" or the products of a size larger than that of the latter remaining on the surface of the mobile sorting plane and being evacuated at its downstream end, the grading or calibrating rolls 1 being mounted with adjustable gaps between them. The end supports 3, 4 of the grading rolls 1 are mounted with a capability for limited translation, on two parallel lateral slides 11, 12, oriented perpendicularly to the axis of said rolls the gap variations "e" of which are obtained by interposing elastic elements 10 between said end supports 3, 4 and by the compression or extension of these elastic elements 10 also mounted with a capability of axial displacement on said lateral slides 11, 12.

This process thus enables the approaching or distancing of the end supports 3, 4 and the grading rolls 1 supported by the latter, depending on the nature of the elastic elements 10 contrary to the antagonistic action exerted by said elastic elements, so as to decrease or increase the cross section of the openings 7 for pass-through of the sorted or calibrated products depending on the size of the clusters to be sorted, the approach or distancing of the end supports 3, 4 and of the grading rolls 1 being achieved through the action of extension or compression of said elastic elements 10.

This process is more particularly applicable to harvesting machines in which the sorting table is positioned above a collecting vessel of the sorted products; it is remarkable in that one neutralizes the sorting function while conserving the conveying function of said sorting table, by moving all rolls 1, 2 of the latter in the upstream direction and by creating a space "E" comprised between the downstream end 6 of the sorting table and one of the sides of the vessel. The process thus permits to create an opening for direct access of the unsorted or not calibrated products to said receiving vessel C, so as to result in the dropping of the clusters and grapes into the vessel and the ejection, outside of said vessel C, of woods (canes S) mixed in with the conveyed crop.

FIGS. 14, 15, 16, and 17 illustrate an example of implementation of this process as it applied to a sorting table the elastic elements 10 of which consist of spiral springs acting in compression or of elastically compressible elements.

In order to obtain the position of the sorting table illustrated in FIGS. 14, 15, 16, and 17 which allows creating the opening "E" for direct access of the crop to the vessel C, one proceeds as follows:

- to begin with, if the grading rolls 1 are not already in such a position, the control 31 is actuated in order to position the grading rolls 1 in a maximum gap position corresponding to a maximum cross section of openings 7;
- after having achieved this first stage, or if the grading rolls are already placed in a position of maximum gap, the control 32 is actuated, bringing the compression bars 28*a*, 28*b* into contact with the downstream roll, in order to move all end supports 3, 4, and consequently, all grading rolls 1, in the upstream direction, into a position of minimum width, corresponding to a minimum cross section of the openings 7.

In the case where the elastic elements 10 consist of spiral extension springs, the implementation process will be essentially identical.

Figure 18:
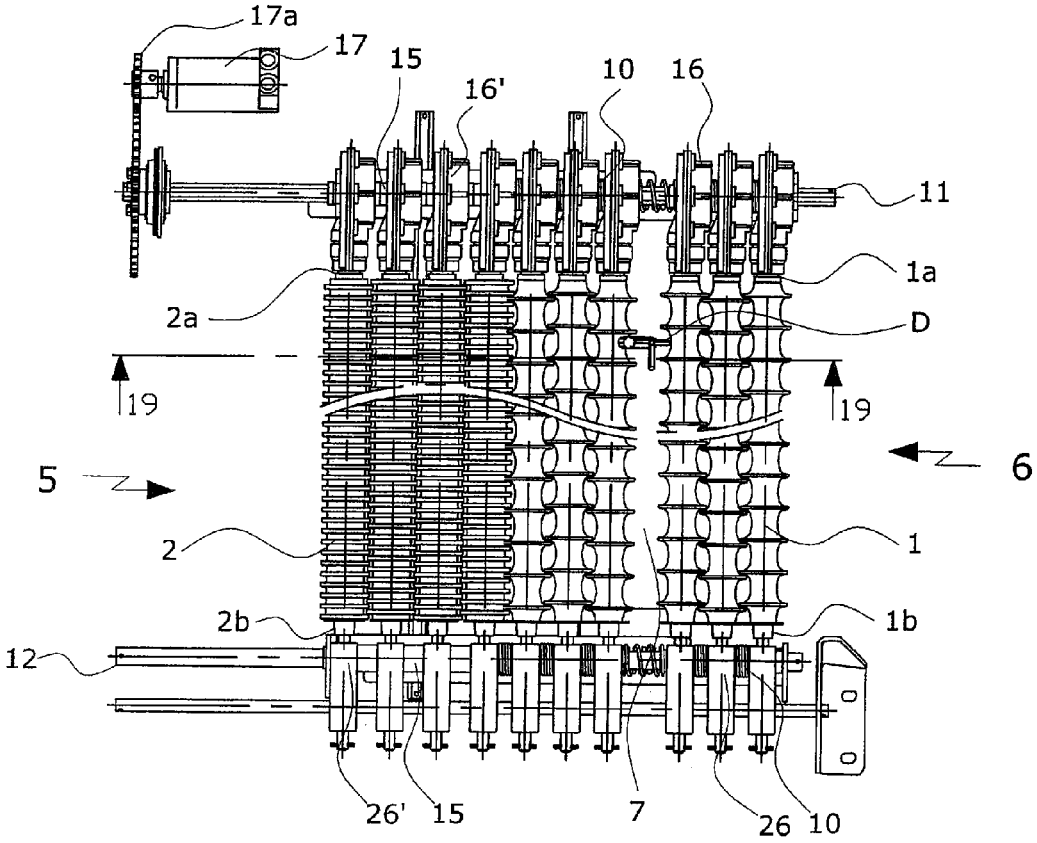
FIGS. 18 and 19 are views, from above and in a section respectively, showing the automatic gap between two adjacent grading rolls when a jam occurs because of a hard object mixed in with the crop.
Figure 19:
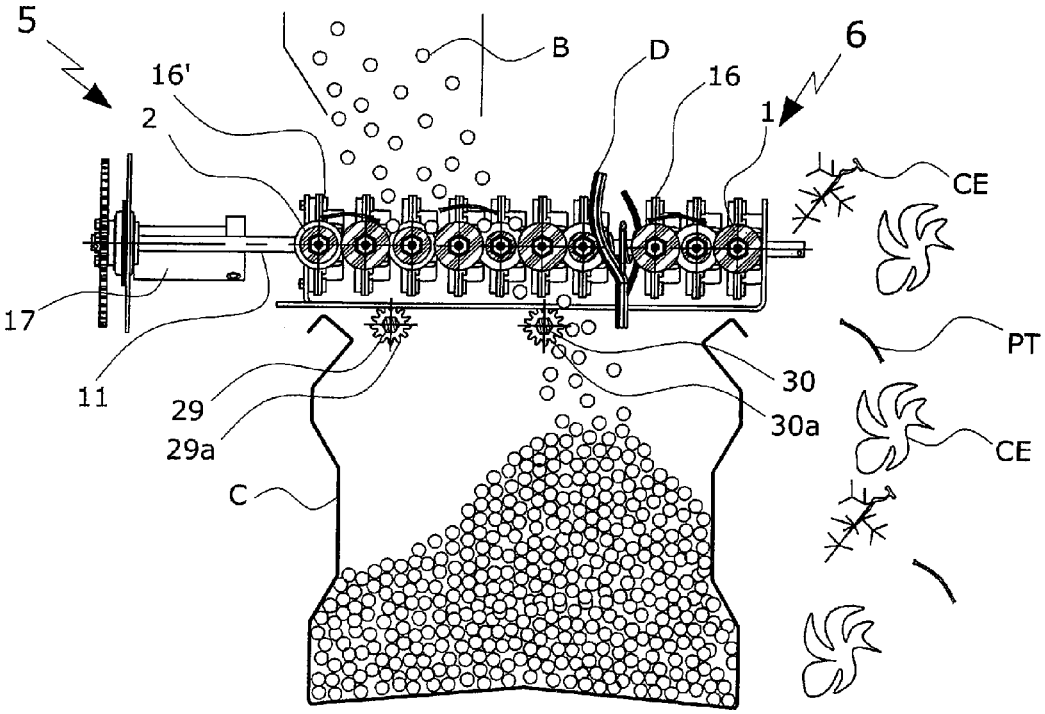

FIGS. 18 and 19 show a relatively voluminous body D of a degree of hardness that would be capable of causing a deformation of rolls 1 if these were mounted without any possibility of deletion.

Therefore, because of the characteristic arrangements of the sorting table according to the invention that have been described previously, if a hard body D among the crop products gets between two adjacent grading rolls 1 of the sorting table, these rolls being linked by said elastic elements 10, will be able to deviate under the action of said hard body D so that it can travel across the sorting table. When the rolls 1 are freed from this deviating action imposed by the presence of the hard body D, the grading rolls will automatically regain their initial position under the effect of the antagonistic action of the elastic elements 10.

We claim:

1. A sorting table apparatus comprising:

a plurality of grading rolls supported by end supports, said plurality of grading rolls arranged in parallel in succession of each other so as to form a sorting plane;

a means for rotatingly driving said plurality of grading rolls in the same direction, said plurality of rolls being arranged so as to define at least one opening between adjacent grading rolls so as to allow only a pass-through and a drop-off of products to be sorted and such that objects of a size larger than the products to be sorted remain on a surface of the sorting plane and removed at a downstream end of the sorting plane;

a means for modifying the opening, said end supports being mounted so as to have a limited translation on at least one lateral slide oriented perpendicularly to an axis of the grading rolls;

a plurality of elastic elements interposed between said end supports; and a means for activating an approach or a distancing of said end supports and of said plurality of grading rolls supported by said end supports in opposition to a force exerted by said plurality of elastic elements so as to decrease or increase a cross-sectional area of the opening, a displacement in a direction opposite of said end supports and of said plurality of grading rolls being performed by extension or compression of said plurality of elastic elements, said means for rotatingly driving being said lateral slide.

2. The apparatus of claim 1, said plurality of grading rolls mounted to said lateral slide and to another lateral slide oriented perpendicularly to the axis of said plurality of grading rolls, said plurality of elastic elements being interposed between said end supports.

3. The apparatus of claim 1, further comprising:

a plurality of feeder rolls positioned upstream of said plurality of grading rolls, said plurality of feeder rolls support by said end supports.

4. The apparatus of claim 1, said lateral slide having a cross section coupled in rotation with an input organ of an angle transmission integrated in said end supports, said angle transmission coupled removably to a drive end of said plurality of grading rolls.

5. The apparatus of claim 1, said plurality of elastic elements mounted coaxially around said lateral slide.

6. The apparatus of claim 1, said lateral slide having a polygonal or egg-shaped cross section.

7. The apparatus of claim 6, said lateral slide having a hexagonal cross section.

8. The apparatus of claim 1, said means for actuating comprising a compression or extension bar, the bar being axially movable and having one end in contact with the end support of an upstream grading roll of said plurality of grading rolls.

9. The apparatus of claim 8, said means for actuating further comprising an axially mobile push or traction bar having an end in contact with the end support of a downstream grading roll of said plurality of grading rolls.

10. The apparatus of claim 9, the compression or extension bar being a rack, each couple of the push or traction bars being connected by at least one shaft so as to carry out synchronized displacement.

11. The apparatus of claim 8, said compression or extension bar comprising a plurality of compression or extension bars in which displacement of couples of said plurality of compression or extension bars are displaced by pinions connected to a synchronization shaft positioned cross-wise below the sorting plane.

12. The apparatus of claim 11, said synchronization shaft having the pinion mounted at one end thereof, the pinion meshing with a sector gear that is connected to a manually-operated tipping control lever.

13. The apparatus of claim 11, said synchronization shaft having a drive end coupled to a motor, said motor suitable for rotating said synchronization shaft.

14. A sorting table for a harvesting machine for small fruit comprising:

a plurality of grading rolls supported by end supports, said plurality of grading rolls arranged in parallel in succession of each other so as to form a sorting plane;

a means for rotating driving said plurality of grading rolls in the same direction, said plurality of rolls being arranged so as to define at least one opening between adjacent grading rolls so as to allow only a pass-through and a drop-off of products to be sorted and such that objects of a size larger than the products to be sorted remain on a surface of the sorting plane and removed at a downstream end of the sorting plane;

a means for modifying the opening, said end supports being mounted so as to have a limited translation on at least one lateral slide oriented perpendicularly to an axis of the grading rolls;

a plurality of elastic elements interposed between said end supports; and a means for activating an approach or a distancing of said end supports and of said plurality of grading rolls supported by said end supports in opposition to a force exerted by said plurality of elastic elements so as to decrease or increase a cross-sectional area of the opening, a displacement in a direction opposite of said end supports and of said plurality of grading rolls being performed be extension or compression of said plurality of elastic elements, said means for rotatingly driving being said lateral slide.

15. The sorting table for the harvesting machine of claim 14, further comprising:

a plurality of feeder rolls positioned upstream of said plurality of grading rolls; and a stripping device positioned above said plurality of feeder rolls.

16. The sorting table for the harvesting machine of claim 14, further comprising:

at least one receiving bin having an upper opening, the upper opening of the receiving bin positioned below the sorting plane.

17. The sorting table for the harvesting machine of claim 16, further comprising:

a means for displacing all of said plurality of grading rolls in an upstream direction so as to create a downstream opening formed by one of upper edges of the receiving bin.

18. A sorting table comprising:

a plurality of grading rolls rotatable in a common direction;

a plurality of end supports positioned parallel to each other in succession so as to form a sorting plane, said plurality of grading rolls being shaped or positioned so as to form at least one opening between an adjacent pair of said plurality of grading rolls so as to permit only a pass-through and a drop-off of products to be sorted or calibrated, said sorting plane retaining objects of a larger size than the passed-through or dropped-off products thereon and evacuated at a downstream end of said sorting plane, said plurality of grading rolls being mounted with an adjustable gap, said plurality of end supports being mounted with limited translatability on at least one lateral slide that is oriented perpendicular to an axis of the grading roll; and a plurality of elastic elements interposed between the end supports, said at least one lateral slide causing a rotational drive of said plurality of grading rollers.

19. The sorting table of claim 18, further comprising:

a collecting vessel positioned below said sorting plane, said collecting vessel having a side, an opening defined between the downstream end of said sorting plane and said side of said collecting vessel.

* * * * *